US010290440B2

(12) United States Patent
Teplitxky et al.

(10) Patent No.: US 10,290,440 B2
(45) Date of Patent: May 14, 2019

(54) WATERPROOF BUTTON ASSEMBLY

(71) Applicant: Apple Inc., Cupertino, CA (US)

(72) Inventors: Pierre M. Teplitxky, Cupertino, CA (US); Colin M. Ely, Cupertino, CA (US); Fletcher R. Rothkopf, Los Altos, CA (US); Anna-Katrina Shedletsky, Mountain View, CA (US); Samuel B. Weiss, Menlo Park, CA (US)

(73) Assignee: APPLE INC., Cupertino, CA (US)

( * ) Notice: Subject to any disclaimer, the term of this patent is extended or adjusted under 35 U.S.C. 154(b) by 335 days.

(21) Appl. No.: 14/170,051

(22) Filed: Jan. 31, 2014

(65) Prior Publication Data

US 2015/0221460 A1 Aug. 6, 2015

(51) Int. Cl.
*H01H 13/06* (2006.01)
*H01H 11/00* (2006.01)

(52) U.S. Cl.
CPC ..... *H01H 13/06* (2013.01); *H01H 11/00* (2013.01); *H01H 2215/006* (2013.01); *H01H 2233/074* (2013.01); *Y10T 29/49105* (2015.01)

(58) Field of Classification Search
CPC ..... H01H 9/04; H01H 13/36; H01H 13/48; H01H 2233/074; H01H 2233/058; H01H 13/365; H01H 9/08; H01H 13/06; H01H 2215/006
USPC ..... 200/302.2, 302.1, 341, 516, 517, 50.02, 200/295, 556
See application file for complete search history.

(56) References Cited

U.S. PATENT DOCUMENTS

| | | | | |
|---|---|---|---|---|
| 4,037,068 | A | 7/1977 | Gaynor | |
| 4,258,096 | A | 3/1981 | LaMarche | |
| 4,324,956 | A * | 4/1982 | Sakakino et al. | 200/302.1 |
| 4,345,119 | A | 8/1982 | Latasiewicz | |
| 4,581,509 | A * | 4/1986 | Sanford et al. | 200/302.1 |
| 4,922,070 | A | 5/1990 | Dorkinski | |
| 5,258,592 | A * | 11/1993 | Nishikawa et al. | 200/302.2 |
| 6,355,891 | B1 | 3/2002 | Ikunami | |
| 6,525,278 | B2 | 2/2003 | Villain et al. | |
| 6,963,039 | B1 | 11/2005 | Weng et al. | |
| 7,119,289 | B2 | 10/2006 | Lacroix | |

(Continued)

FOREIGN PATENT DOCUMENTS

| | | |
|---|---|---|
| EP | 2720129 | 4/2014 |
| KR | 20080045397 | 5/2008 |

*Primary Examiner* — Felix O Figueroa
(74) *Attorney, Agent, or Firm* — Dorsey & Whitney LLP

(57) ABSTRACT

A waterproof button assembly. The waterproof button assembly may include a housing including an opening and a button. The button may be positioned at least partially within the housing via the opening. The assembly may also include a plurality of engagement components positioned on opposite-distal ends of the button. The plurality of engagement components may be configured to retain the button within the housing. The engagement components may extend distally from the button, such that a portion of the engagement components may be positioned within apertures formed in the sidewall of the housing. The assembly may also include a plurality of supports, a tactile dome in contact with the button and at least one of the plurality of supports. A sensing component of the assembly may be positioned adjacent the housing and in alignment with the button and/or tactile dome for sensing actuation of the button within the assembly.

18 Claims, 16 Drawing Sheets

(56) References Cited

U.S. PATENT DOCUMENTS

| | | | | |
|---|---|---|---|---|
| 8,167,126 | B2 | 5/2012 | Stiehl | |
| 8,248,815 | B2 * | 8/2012 | Yang et al. | 200/339 |
| 8,263,886 | B2 | 9/2012 | Lin et al. | |
| 8,263,889 | B2 | 9/2012 | Takahashi et al. | |
| 8,432,368 | B2 | 4/2013 | Momeyer et al. | |
| 8,446,713 | B2 | 5/2013 | Lai | |
| 8,576,044 | B2 | 11/2013 | Chapman | |
| 8,885,856 | B2 | 11/2014 | Sacha | |
| 2004/0082414 | A1 | 4/2004 | Knox | |
| 2009/0312051 | A1 | 12/2009 | Hansson et al. | |
| 2012/0067711 | A1 | 3/2012 | Yang | |
| 2013/0037396 | A1 * | 2/2013 | Yu | 200/293 |
| 2013/0087443 | A1 | 4/2013 | Kikuchi | |
| 2015/0228423 | A1 | 8/2015 | Sanford et al. | |
| 2016/0313703 | A1 | 10/2016 | Ely et al. | |

* cited by examiner

WATERPROOF BUTTON ASSEMBLY

TECHNICAL FIELD

The disclosure relates generally to electronic devices, and more particularly, to input devices for electronic devices.

BACKGROUND

Current electronic devices typically include various input devices. These input devices allow a user to interact with the electronic device during operation. One conventional input device frequently included in electronic devices is a push-button. Push-buttons allow a user to easily engage the electronic device by engaging an internal switch to either an open position, or closed position, which may ultimately send an electronic signal to a component of the electronic device.

However, because of the actuation or movement required for a push-button to operate, the configuration of conventional push-buttons may make the push-button vulnerable to operational degradation, and/or may allow the push-button to be undesirably exposed to harmful elements. For example, conventional push-buttons and its internal components may be vulnerable to damage caused by exposure to water as a result of inadequate sealing conditions within the push-button. That is, conventional push-buttons often including sealing components (e.g., rubber diaphragms, O-ring seals) to substantially prevent water from entering the push-button and contacting the internal components of the push-button. However, these seal components typically have finite lifespans because of their design, composition and/or interaction within the push-button. During the lifespan of the push-button these seal components become less effective in sealing the push-button due to abrasion, cracking and/or general fatigue.

In addition, the configuration of conventional push-buttons, and specifically the through hole to the interior of a housing for the push-button, prevents any seal component used within the push-button from guaranteeing a perfect seal within the push-button. That is, due to the openings operationally-required in conventional push-buttons, no seal component may be implemented within the push-button to completely seal the push-button from water, without negatively effecting the function or actuation of the push-button. As a result, seal components implemented in conventional push-buttons may only minimize the risk of damage to push-buttons from water exposure, but may not completely prevent the damage.

SUMMARY

Generally, embodiments discussed herein are related to a waterproof button assembly and a method of assembling the waterproof button assembly. The waterproof button assembly may include a housing made of a single, integral component, and a button positioned within the housing. Furthermore, the waterproof button assembly may include a sensing component positioned below the housing. By including a single, integral component to form the housing, there may be no through holes in the button assembly to allow water to reach the sensing component. That is, any water that may enter the housing between the button and the housing, may be substantially trapped within the housing, and may not come in contact with the sensing component of the waterproof button assembly positioned below and/or outside of the housing.

One embodiment may include a waterproof button assembly. The waterproof button assembly may include a housing having an opening, and a button positioned at least partially within the housing via the opening. Additionally, the waterproof button assembly may include a plurality of engagement components positioned on opposite-distal ends of the button. The plurality of engagement components may retain the button within the housing.

Another embodiment may include an electronic device. The electronic device may include a casing, and a waterproof button assembly coupled to the casing. The waterproof button assembly may include a housing including an opening, and a button positioned at least partially within the housing via the opening. Additionally, the waterproof button assembly coupled to the casing of the electronic device may include a plurality of engagement components for retaining the button within the housing.

A further embodiment may include method for assembling a waterproof button. The method may include coupling a plurality of clips to distal ends of a button, compressing the plurality of clips into the button, and inserting the button and the plurality of compressed clips into a housing. The method may also include extending the plurality of clips of the button within the housing, and retaining the button within the housing via the plurality of extended clips.

BRIEF DESCRIPTION OF THE DRAWINGS

The disclosure will be readily understood by the following detailed description in conjunction with the accompanying drawings, wherein like reference numerals designate like structural elements, and in which.

Figure 1:
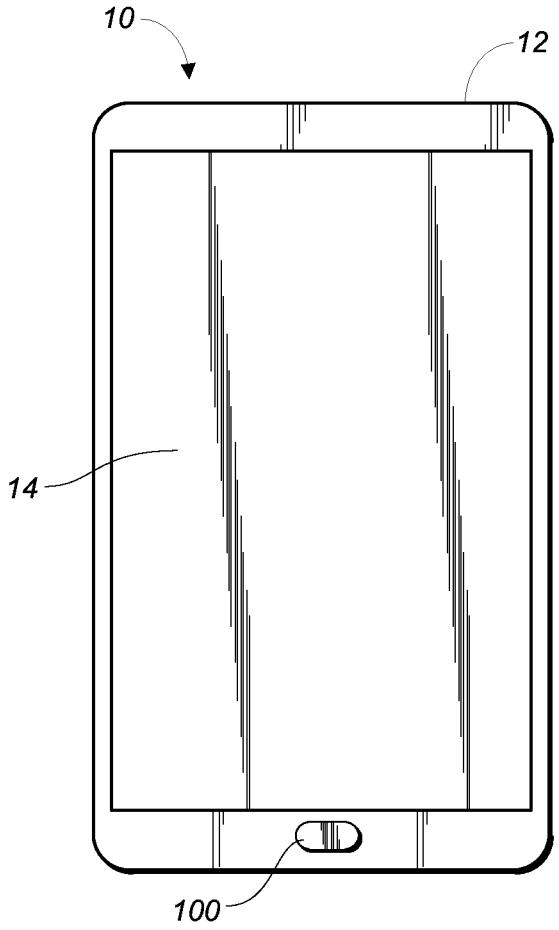
FIG. 1 shows an illustrative plane view of an electronic device including a waterproof button assembly, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to an electronic devices, and more particularly, to a waterproof button assembly and a method of assembling the waterproof button assembly.

In a particular embodiment the waterproof button assembly may include a housing made of a single, integral component, and a button positioned within the housing. Furthermore, the waterproof button assembly may include a sensing component positioned below the housing. By including a single, integral component to form the housing, there may be no through holes in the button assembly to allow water to reach the sensing component. That is, any water that may enter the housing between the button and the housing, may be substantially trapped within the housing, and may not come in contact with the sensing component of the waterproof button assembly positioned below and/or outside of the housing.

The waterproof button assembly may include a housing having an opening, and a button positioned at least partially within the housing via the opening. Additionally, the waterproof button assembly may include a plurality of engagement components positioned on opposite-distal ends of the button. The plurality of engagement components may retain the button within the housing.

The method for assembling a waterproof button may include coupling a plurality of clips to distal ends of a button, compressing the plurality of clips into the button, and inserting the button and the plurality of compressed clips into a housing. The method may also include extending the plurality of clips of the button within the housing, and retaining the button within the housing via the plurality of extended clips.

These and other embodiments are discussed below with reference to FIGS. 1-14. However, those skilled in the art will readily appreciate that the detailed description given herein with respect to these Figures is for explanatory purposes only and should not be construed as limiting.

Referring now to FIG. 1, there is shown a plane perspective view of one example of an electronic device 10 that can include, or be connected to a biometric sensing device (not shown). In the illustrated embodiment, electronic device 10 is implemented as a smart telephone. Other embodiments can implement the electronic device 10 differently, such as, for example, as a laptop or desktop computer, a tablet computing device, a gaming device, a display, a digital music player, a wearable computing device or display such as a watch or glasses, and other types of electronic devices that can receive biometric data from a biometric sensing device.

The electronic device 10 includes an casing 12 at least partially surrounding a display 14 and one or more waterproof button assemblies 100. Enclosure 12 can form an outer surface or partial outer surface and protective case for the internal components of electronic device 10, and may at least partially surround display 14. Enclosure 12 can be formed of one or more components operably connected together, such as a front piece and a back piece. Alternatively, enclosure 12 can be formed of a single piece operably connected to the display 14.

Display 14 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. As discussed herein, waterproof button assembly 100 may be utilized by electronic device 10 to provide user input and/or allow the user to interact with the various functions of electronic device 10.

Figure 2:
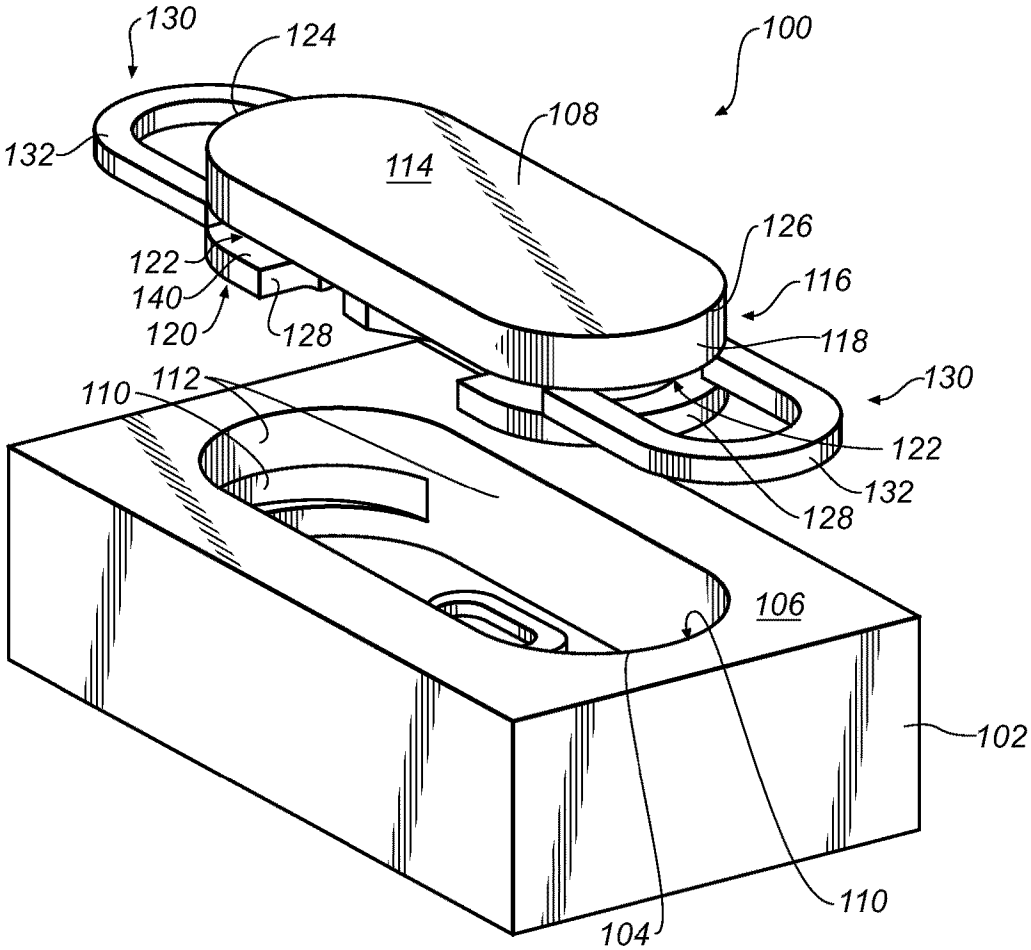
FIG. 2 shows an illustrative partially exploded perspective view of a waterproof button assembly, according to embodiments.

Turning to FIG. 2, a partially exploded perspective view of a waterproof button assembly 100 is shown according to embodiments of the invention. Waterproof button assembly 100 may include a housing 102 including an opening 104. Housing 102 may include a single, continuous component. That is, as shown in FIG. 2, opening 104 may only extend through a top surface 106 and extend partially through housing 102, such that housing 102 may be formed from a single, continuous component. As discussed herein, housing 102 may be configured to receive a button 108 via opening 104. Opening 104 may be configured as a substantially elongated ellipse as shown in FIG. 2. However, it is understood that the shape of opening 104 of housing 102 may be dependent, at least in part, on the shape of button 108.

Figure 4:
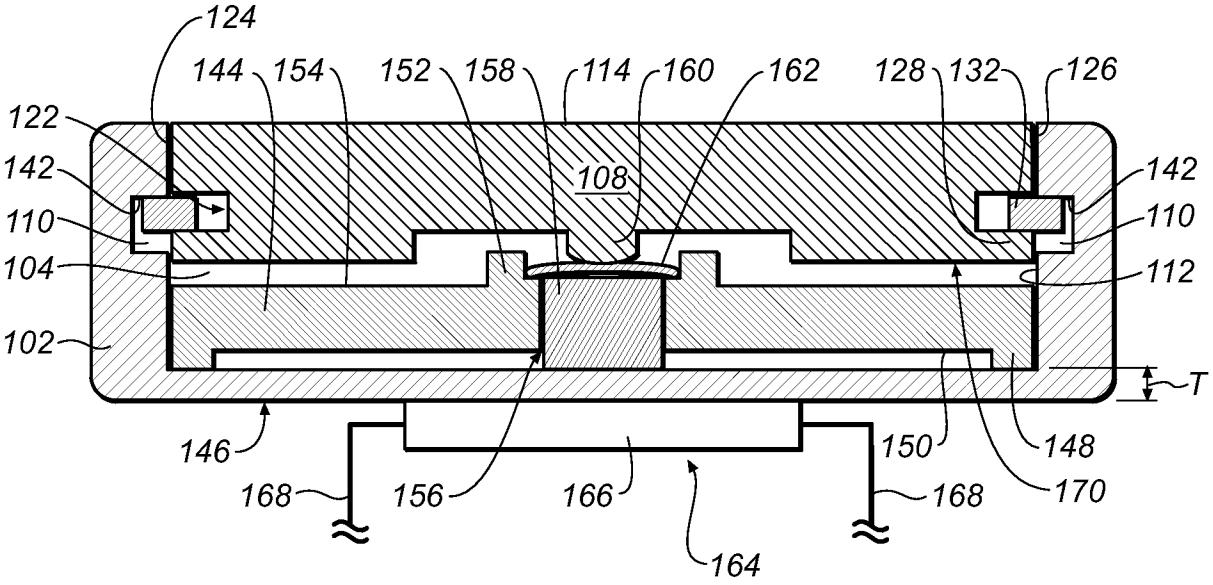
FIG. 4 shows an illustrative front cross-sectional view of a waterproof button, according to embodiments.

As shown in FIG. 2, housing 102 may also include a plurality of apertures 110 formed in a sidewall 112 of housing 102. Each of the plurality of apertures 110 may include a cavity or recess formed partially through sidewall 112 of housing 102, such that housing 102 may remain a single, continuous component. Briefly turning to FIG. 4, with continued reference to FIG. 2, housing 102 may include two apertures 110 positioned or formed within sidewall 112, opposite one another. That is, each of the two apertures 110 may be formed within sidewall 112 and may be positioned on opposite ends of housing 102. As discussed herein, each of the plurality of apertures 110 of housing 102 may be configured to receive a portion of button 108 to aid in coupling or retaining button 108 within housing 102. As shown in FIGS. 2 and 4, sidewalls 112 of housing 102 may be substantially thick to provide a rigid support for button 108 during actuation. As discussed herein, sidewalls 112 may also provide support for segments of a base portion of housing 102 positioned directly adjacent sidewalls 112 during actuation of button 108.

Housing 102 may be made of any conventional material capable of forming a substantially rigid structure. That is housing 102 may be made from any conventional material including, but not limited to: polymer, metal, glass, etc. Additionally, housing 102 may be made using any conventional manufacturing process or combination of processes including, but not limited to: molding, casting, milling, drilling, forming, joining, etc.

Waterproof button assembly 100, as shown in FIG. 2, may also include button 108 configured to be positioned within housing 102. More specifically, with reference to FIG. 4, button 108 may be positioned at least partially within housing 102 via opening 104. In an embodiment, for example as shown in FIG. 4, substantially all of button 108 may be positioned within housing 102, such that top surface 114 of button 108 may be in planar alignment with top surface 106 of housing 102. In the embodiment, and as discussed herein, top surface 114 of button 108 may be in planar alignment with top surface 106 of housing 102 during an unactuated state of button 108 and may be positioned substantially below top surface 106 during an actuated state (e.g., FIG. 6C). In an alternative embodiment, top surface 114 and a portion of button 108 may be exposed and extend above top surface 106 of housing 102. In the alternative embodiment, top surface 114 of button 108 may extend above top surface 106 of housing 102 during both an actuated and unactuated state of button 108, or may only extend above housing 102 during an unactuated state of button 108.

As shown in FIG. 2, button 108 may include a upper portion 116 including top surface 114. Upper portion 116 may include a perimeter 118 that may be positioned substantially adjacent sidewalls 112 or may substantially contact sidewalls 112 when button 108 is positioned within housing 102 (e.g., FIG. 4). Perimeter 118 of button 108 may include a shape substantially identical to opening 104 formed through top surface 106 of housing 102. That is, as shown in FIG. 2, perimeter 118 of button 108 and opening 104 of housing 102 may include substantially similar curved and linear portions, where the curvature of a curved portion of button 108 is substantially concentric or in alignment with the curvature of a corresponding curved portion of opening 104. As a result, perimeter 118 of button 108 and opening 104 of housing 102 may be substantially concentric or nested, where at least a portion of button 108 is positioned within opening 104 of housing 102. As discussed herein, the distance or space between perimeter 118 of button 108 and sidewalls 112 of housing 102 may be substantially minimal where perimeter 118 is positioned substantially adjacent sidewalls 112 or may not be present where perimeter 118 contacts sidewalls 112. The minimal or non-existent distance or space between perimeter 118 of button 108 and sidewalls 112 of housing 102 may aid in preventing undesirable elements, such as liquid, from entering opening 104 of housing 102, as discussed herein.

Figure 3B:
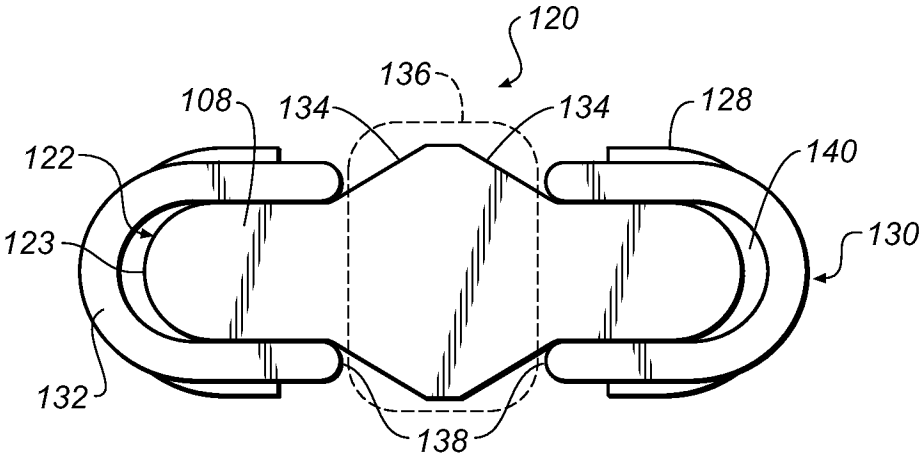
FIG. 3B shows an illustrative cross-sectional view of the button and plurality of clips of FIG. 3A along line 3B, according to embodiments.
Figure 3A:
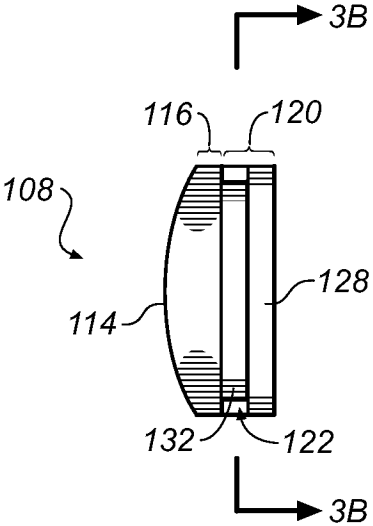
FIG. 3A shows an illustrative side view of a button and a plurality of clips of a waterproof button assembly, according to embodiments.

Button 108 may also include a lower portion 120 positioned opposite and/or below upper portion 116. As shown in FIGS. 2-3B, lower portion 120 of button 108 may include a plurality of grooves 122 positioned on distal ends 124, 126 of button 108, substantially adjacent upper portion 116. The plurality of grooves 122 may include a recess or reduced body portion formed in lower portion 120 of button 108. As shown in FIG. 3B, the plurality of grooves 122 may include an inner surface 123 which may include a substantially U-shaped configuration. That is, inner surface 123 of each of the plurality of grooves 122 may include a curvature that is substantially concentric or in alignment with the curved portion of perimeter 118, and may include linear portions that are substantially parallel or in alignment with the linear portions of perimeter 118. In forming the plurality of grooves 122, lower portion 120 of button 108 may also include shelf portions 128 positioned on distal ends 124, 126 of button 108, adjacent the plurality of grooves 122. Briefly turning to FIG. 4, lower portion 120 of button 108 may be in substantial alignment within apertures 110 formed in sidewalls 112 when button 108 is positioned within housing 102. More specifically, each of the plurality of grooves 122 and the respective shelf portions 128 formed in lower portion 120 of button 108 may be in alignment with one of the plurality of apertures 110 formed in sidewalls 112 when button 108 is positioned within housing 104 and button 108 is in an actuated or unactuated state, as discussed herein.

Button 108 may be made of any conventional material capable of forming a substantially rigid structure. That is button may be made from any conventional material including, but not limited to: polymer, metal, glass, etc. Additionally, button 108 may be made using any conventional manufacturing process or combination of processes including, but not limited to: molding, casting, milling, drilling, forming, joining, etc.

Waterproof button assembly 100 may also include a plurality of engagement components 130 positioned on opposite distal ends 124, 126 of button 108. As discussed herein, the plurality of components 130 may be configured to retain button 108 within housing 102. In an embodiment as shown in FIGS. 2-4, the plurality of engagement components 130 may be include a plurality of clips 132. Each of the plurality of clips 132 may be slidingly engaged to one of the plurality of grooves 122 of button 108. More specifically, as shown in FIG. 3B, each clip 132 may contact a portion of inner surface 123 of each of the plurality of grooves 122, and may be substantially free to move distally while slidingly engaged to button 108. As shown in FIGS. 2 and 3B, a portion of clips 132 may extend outward, beyond distal ends 124, 126 of button 108 when slidingly engaged to button 108. Angled surfaces 134 of center portion 136 of button 108 may substantially maintain clips 132 in a position where a portion of clips 132 extend beyond distal ends 124, 126 of button 108. More specifically, as will be understood with reference to FIG. 3B, as clips 132 move toward the center of button 108 and/or center portion 136 and clips 132 no longer extend beyond distal ends 124, 126, ends 138 of clips 132 may contact angled surface 134 and may be angularly displaced, such that the width of clips 132 may be temporarily increased. As ends 138 move along angled surface 134 and closer to center portion 136, a force (e.g., spring force) may drive clips 132 distally outward, away from center portion 136 to extend beyond distal ends 124, 126 of button 108. As such, clip 132 may only temporarily fail to extend beyond distal ends 124, 126 of button 108, before the force (e.g., spring force) pushes ends 138 of clip 132 away from center portion 136 and a portion of clips 132 extend beyond distal ends 124, 126 of button 108. To provide such a force (e.g., spring force) for correcting the position of clips 132, clips 132 may include any conventional material capable of being substantially rigid, but having elastic-properties including, but not limited to, polymers (e.g., plastics) and metals (e.g., shape-memory alloys).

Clips 132 may also contact and/or be supported by a contact surface 140 of shelf portion 128 of button 108. That is, clips 132 may slidingly engage inner surface 123 of grooves 122, and may be further maintained and supported within groove 122 by resting upon contact surface 140 of shelf portion 128. Contact surface of shelf portion 128 may substantially prevent clips 132 from rotating within grooves 122 of button 108. That is, contact surface 140 of shelf portion 128 and upper portion 116 of button 108 may be outer barriers to substantially maintain clips 132 within groove 122 and prevent clips 132 from rotating while slidingly engaged to inner surface 123 of grooves 122.

Turning to FIG. 4, a cross-sectional side view of waterproof button assembly 100 of FIGS. 2-3B is shown according to embodiments of the invention. It is understood that similarly numbered components may function in a substantially similar fashion. Redundant explanation of these components has been omitted for clarity. As shown in FIG. 4, when button 108 is positioned within housing 102, lower portion 120 of button 108 may be aligned with apertures 110 formed in sidewalls 112 of housing 102. More specifically, at least a portion of groove 122 of button 108 and engagement component 130, shown as clips 132, may be substantially aligned with apertures 110 of housing 102. At least a portion of each of the engagement components 130 may be positioned within one of the plurality of apertures 110 formed in sidewall 112 of housing 102. For example, as shown in FIG. 4, a portion of each of clips 132 positioned within grooves 122 formed on opposite distal ends 124, 126 of button 108 may be positioned within each of the plurality of apertures 110 of housing 102. While button 108 is positioned in housing 102, and/or waterproof button assembly 100 is assembled, a portion of engagement components 130, and specifically clips 132, may be positioned within aperture 110 to retain button 108 within housing 102. Engagement component 130, and specifically clips 132 slidingly engaged to grooves 122 of button 108, may retain button 108 within housing 102 by engaging an underside surface 142 of aperture 110 when button 108 is positioned within housing 102. That is, after button 108 is installed and positioned within housing 102, as discussed herein, clips 132 may extend distally beyond distal ends 124, 126 of button 108 and a portion of each of the clips 132 may be positioned within aperture 110 to engage underside surface 142. Once engaged with underside surface 142, button 108 may be retained within housing 102, as clips 132 may substantially hold button 108 within housing 102 and/or prevent button 108 from being removed from housing 102 via opening 104.

As shown in FIG. 4, waterproof button assembly 100 may also include a first support 144 positioned within housing 102 adjacent button 108. More specifically, first support 144 may be positioned within opening 104 of housing 102 and may be positioned between a base portion 146 of housing 102 and button 108. First support 144 may be configured to include a width marginally smaller than the width of opening 104 formed in housing 102, such that first support 144 may be positioned adjacent to sidewalls 112 of opening 104. As a result of the marginal difference between the width of first support 144 and opening 104, lateral movement of first support 144 within housing 102 may be substantially minimal during operation of waterproof button assembly 100. As discussed herein, during actuation of button 108 of waterproof button assembly 100, first support 144 may be slightly displaced or deformed toward sidewalls 112 of housing 102 to dissipate at least a portion of the force placed on waterproof button assembly 100 during actuation. As shown in FIG. 4, first support 144 may include a bottom ridge 148 formed on a bottom surface 150 of first support 144. Bottom ridge 148 may extend at least partially around the perimeter of first support 144 and may displace a portion of a force applied to button 108 during actuation, as discussed herein. First support 144 may also include top ridge 102 formed on a top surface 106 of first support 144. Top ridge 102 of first support 144 may extend at least partially around an opening 104 formed through first support 144, and may contact lower portion 120 of button 108 during the actuation of button 108, as discussed herein. That is, top ridge 102 of first support 144 may contact lower portion 120 of button 108 during actuation to substantially prevent button 108 from being actuated to an undesirable position, which may ultimately put an undesirable strain on engagement component 130 (e.g., clips 132). As discussed herein, first support 144 may partially deform during the initial actuation of button 108 of waterproof button assembly 100. As such, first support 144 may include any conventional material being relatively rigid, and including semi-elastic characteristics.

Waterproof button assembly 100 may also include a second support 158 positioned within housing 102 adjacent button 108. As shown in FIG. 4, second support 158 may be substantially surrounded by first support 144, and may be positioned within opening 104 of first support 144. Second support 158 may contact base portion 146 of housing 102 and may be positioned substantially in the center of housing 102, between button 108 and base portion 146. Additionally, as shown in FIG. 4, second support 158 may be positioned in alignment with a contact portion 160 of button 108. As discussed herein, contact portion 160 of button 108 may aid in the operation of waterproof button assembly 100 during the actuation of button 108. Second support 158 of waterproof button assembly 100 may be a solid structure having substantially rigid and/or low-elastic characteristics. As discussed herein, during the actuation of button 108 of waterproof button assembly 100, second support 108 may aid in deflecting base portion 146 of housing 102. That is, and as discussed herein, second support 158 may be utilized to aid in the deflection of base portion 146 of housing 102 when button 108 is actuated from an applied-predetermined force or load.

As shown in FIG. 4, waterproof button assembly 100 may also include a tactile dome 162 positioned between second support 108 and button 108. More specifically, tactile dome 162 may be positioned above second support 108 and coupled to first support 144 adjacent top ridges 102. Tactile dome 162 may also be positioned below lower portion 12 of button 108. Tactile dome 162 may be in constant contact with button 108, and specifically contact portion 160 of lower portion 120 of button 108. As discussed herein, during the actuation of button 108 of waterproof button assembly 100, tactile dome 162 may receive a force from contact portion 160 of button 108, and may substantially buckle or deform to provide tactile feedback to a user of waterproof button assembly 100. As shown in FIG. 4, the shape (e.g., dome) of tactile dome 162 may contact portion 160 of button 108, and may be substantially push button 108 toward top surface 106 of housing 102. More specifically, tactile dome 162 may be responsible for applying a force on button 108, via contact portion 160, in a direction toward top surface 106 of housing 102, such that clips 132 may be pushed to contact underside surface 142 of opening 110 of housing 102 to retain button 108 within housing 102. Tactile dome 162 may be configured as any conventional tactile dome 162 configured to be utilized by a button assembly such as waterproof button assembly 100.

In some embodiments, as shown in FIG. 4, waterproof button assembly 100 may include a sensing component 164 positioned adjacent housing 102. More specifically, sensing component 164 may be positioned outside of housing 102, adjacent base portion 146, and in substantial alignment with second support 108 of waterproof button assembly 100. As discussed herein, sensing component 164 may sense actuation of button 108 within housing 102, and may provide an electronic signal to a distinct component or system utilizing waterproof button assembly 100. Sensing component 164 may include any conventional sensor system configured to sense actuation of button 108, via a deflection of base portion 146 of housing 102, and provide a signal indicating actuation. In one embodiment, as shown in FIG. 4, sensing component 164 may be configured as a piezoelectric sensor 166. As discussed herein, when button 108 is actuated, and base portion 146 of housing 102 is deflected into piezoelectric sensor 166, piezoelectric sensor 166 may be deformed by base portion 146 and may send an electrical signal to another component of the electronic device (not shown) via wires 168.

Figure 5:
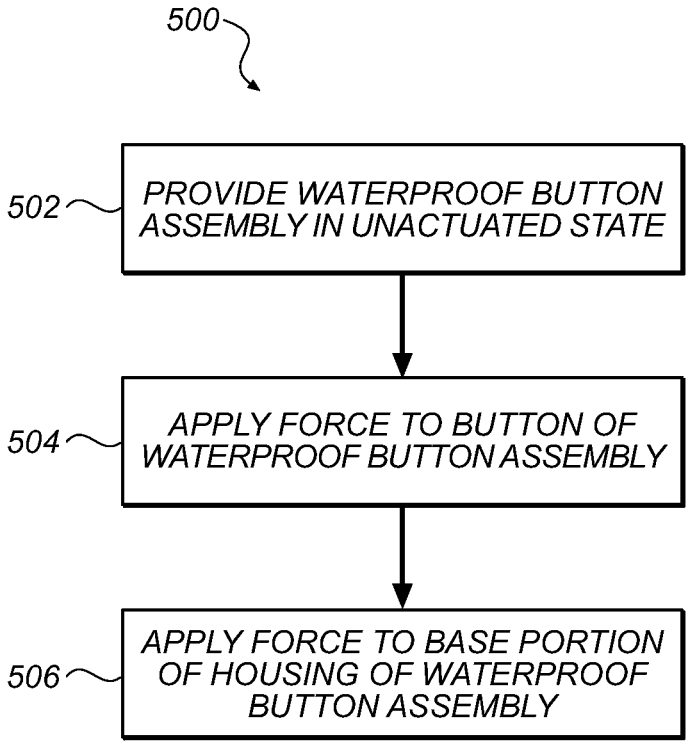
FIG. 5 is a flow chart illustrating a method for actuating a button of a waterproof button assembly. This method may be performed by the waterproof button assembly as shown in FIGS. 2-4.
Figure 6A:
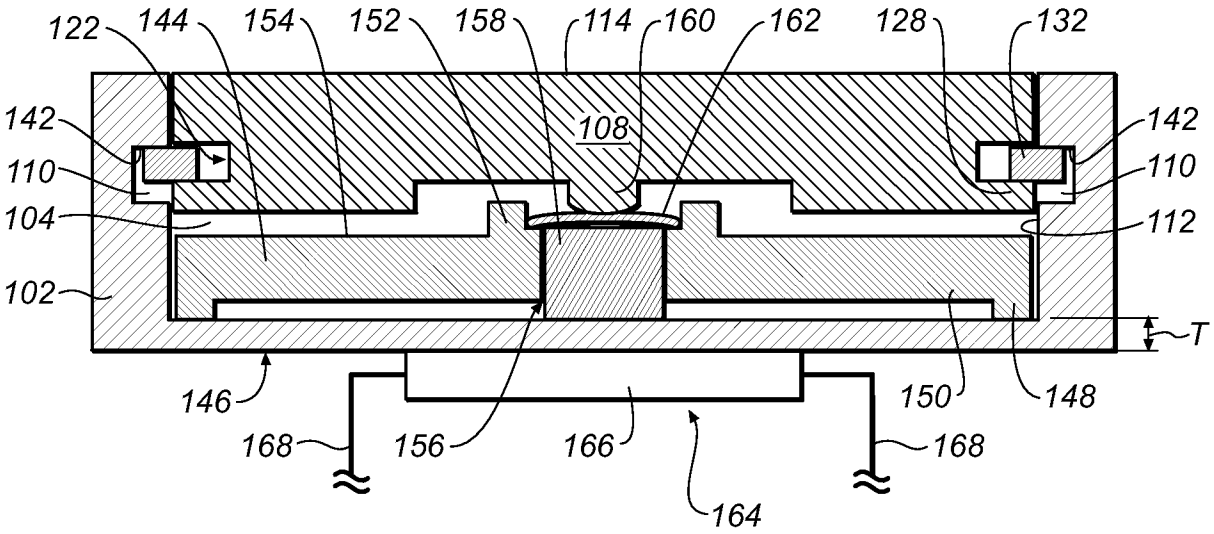
FIGS. 6A-6C show an illustrative front cross-sectional view of a waterproof button assembly undergoing processes of actuating as depicted in FIG. 5, according to embodiments.
Figure 6B:
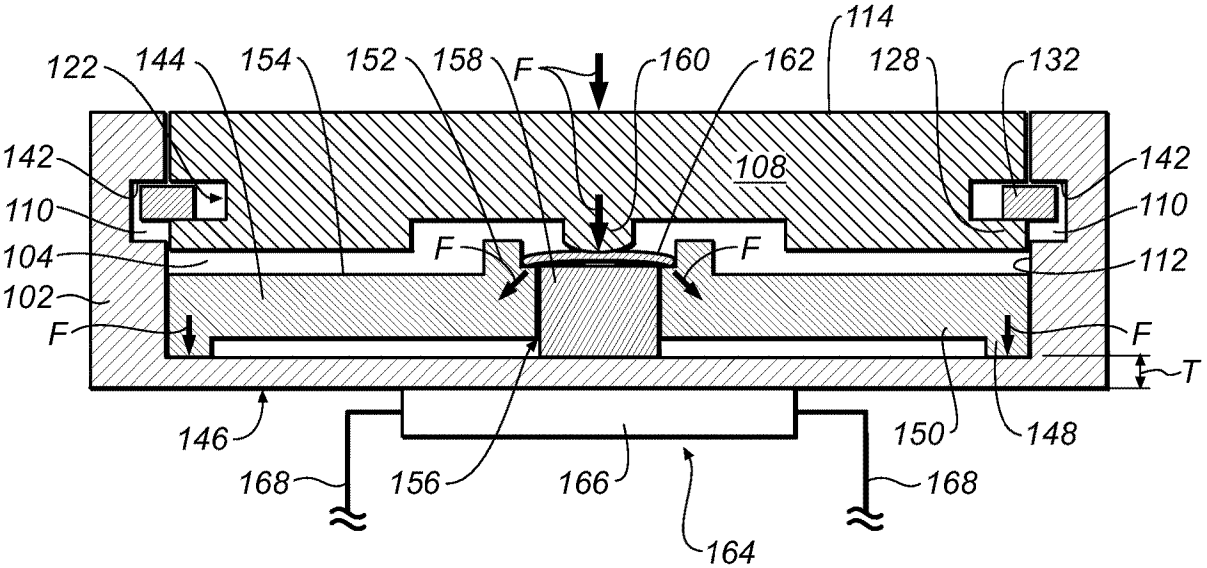
Figure 6C:
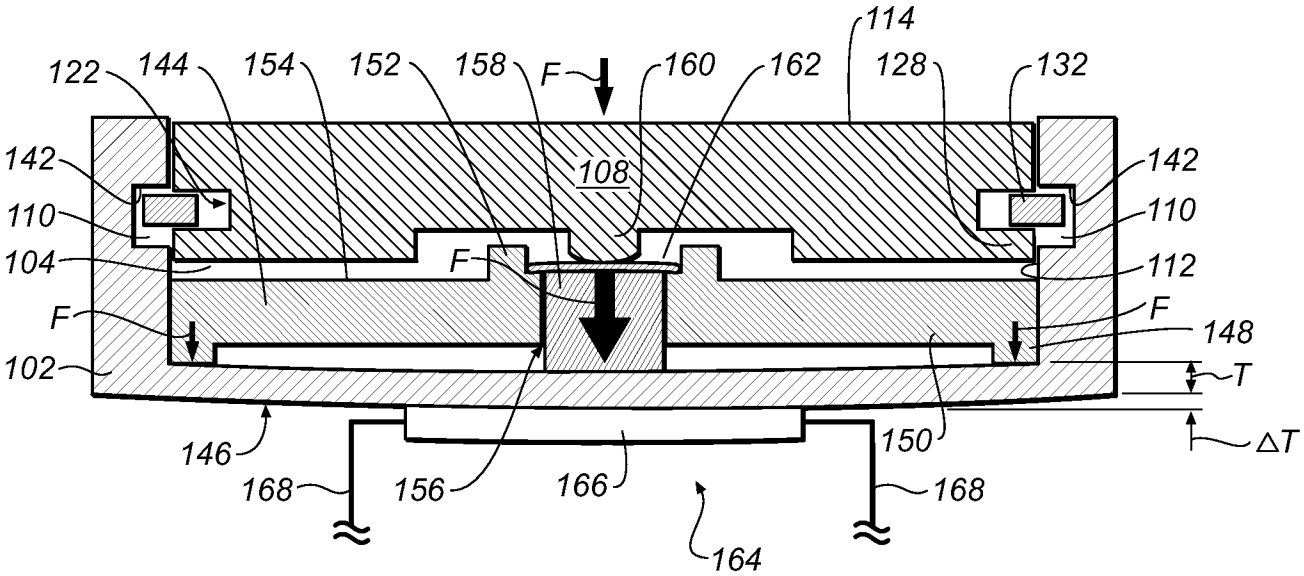

Turning to FIGS. 5-6C, a process of actuating button 108 within waterproof button assembly 100 may now be discussed. Specifically, FIG. 5 is a flowchart depicting one sample method 500 for actuating button 108 within waterproof button assembly 100. FIGS. 6A-6C may depict waterproof button assembly 100 undergoing method 500, as depicted in FIG. 5. It is understood that similarly numbered components may function in a substantially similar fashion. Redundant explanation of these components has been omitted for clarity.

In operation 502, waterproof button assembly 100 included in electronic device 10 may be provided in an unactuated state. As shown in FIG. 6A, and discussed herein with respect to FIGS. 2-4, top surface 114 of button 108 may be in planar alignment with top surface 106 of housing 102. Additionally, contact portion 160 of button 108 may be in contact with tactile dome 162, where tactile dome 162 is not displaced or deformed by contact portion 160 of button 108. That is, button 108 may rest upon tactile dome 162 via contact portion, without displacing or deforming tactile dome 162 in an unactuated state. Also shown in FIG. 6A, base portion 146 may not be displaced or deformed in an unactuated state of button 108 of waterproof button assembly 100. Base portion 146 of housing 102 may be in substantial parallel alignment with top surface 106 of housing 102 in an unactuated state of button 108, and may include uniform thickness (T). As a result, in an unactuated state of button 108, piezoelectric sensor 166 (e.g., sensing component 164) may also be in substantial parallel alignment with top surface 106 of housing 102, and may not be displaced or deformed by base portion 146 of housing 102.

In operation 504, a force (F) may be applied to button 108 of waterproof button assembly 100. As shown in FIG. 6B, the force (F) may be applied to top surface 114 of button 108, and may be applied in a direction toward base portion 146 of housing 102. When the force (F) is initially applied to button 108, button 108 may be in a partially actuated state. In the partially actuated state, as shown in FIG. 6B, button 108 may be slightly displaced. That is, engagement components 130, and specifically clips 132, of button 108 may no longer contact underside surface 142 of apertures 110, and button 108 may float within opening 104 of housing 102. Furthermore, in the initial applying of the force (F), contact portion 160 of button 108 may remain in contact with tactile dome 162, and may apply enough of a force to displace tactile dome 162 in a lateral direction. That is, as shown in FIG. 6B, and with comparison to FIG. 6, tactile dome 162 may retain its dome shape when the force (F) is initially applied to button 108, however, the height of tactile dome 162 may be reduced as a result of the force (F) slightly flattening tactile dome 162. When tactile dome 162 is displaced in a lateral direction, the applied forced (F) may initially be dispersed or distributed throughout first support 144. More specifically, as tactile dome 162 is displaced in a lateral direction, tactile dome 162 may apply a substantially lateral force on top ridge 102 of first support 144, which may in turn increase the width of first support 144 positioned within opening 104 of housing 102. Additionally, the space between first support 144 and second support 108 may also increase, as tactile dome 162 is displaced laterally as a result of the force (F) being initially applied to button 108. This force may continue to be distributed from top ridge 152 to bottom ridge 148 of first support 144. As shown in FIG. 6B, bottom ridge 148 may direct the force against base portion 146 near sidewalls 112 of housing 102. As discussed herein, sidewalls 112 may be substantially thick to prevent portions of base portion 146 positioned directly adjacent sidewalls 112 from deforming under the force (F) in its initial application. As such, in the partially actuated state, base portion 146 of waterproof button assembly 100 may remain substantially free from displacement or deformation, and may maintain uniform thickness (T). Additionally, as a result of tactile dome 162 distributing the initial force only to first support 144, second support 108 may remain substantially free from displacement or deformation. Finally, piezoelectric sensor 166 (e.g., sensing component 164) may also be unaffected by the force (F) initially applied to button 108, and may remain in substantial parallel alignment with top surface 106 of housing 102. That is, because the force (F) does not initially deform base portion 146, piezoelectric sensor 166 may not be deformed or displaced, and no electric current may be passed to distinct components of electric device 10 (FIG. 1) when button 108 is in a partially actuated state.

In operation 506, the force (F) may be applied to base portion 146 of housing 102 of waterproof button assembly 100. As shown in FIG. 6C, the force (F), as previously discussed with respect to operation 504 and FIG. 6B, may continue to be applied to top surface 114 of button 108, and may be applied in a direction toward base portion 146 of housing 102. When the force (F) is applied to base portion 146, button 108 may be in an actuated state. In operation 506, force (F) may be applied with a continuous magnitude over a period of time required for button 108 to be in an actuated state (e.g., FIG. 6C), or the force (F) may vary, where the force applied for button 108 to be in an actuated state (e.g., FIG. 6C) is greater than the force applied to for button 108 to be in a partially actuated state (e.g., FIG. 6B). Force (F) may be applied to base portion 146 when button 108 is in an actuated state by providing the force (F) applied to top surface 114 of button 108 through button 108 and second support 158, respectively. That is, when applying a force to base portion 146 to place button 108 in an actuated position, first support 144 may no longer displace or distribute the force (F) through its respective components (e.g., bottom ridge, 148, top ridge 102), as discussed with respect to FIG. 6B. Rather, as shown in FIG. 6C, tactile dome 162 may collapse and become substantially flat, such that the force applied to button 108 may be transferred from contact portion 160 to second support 158 without tactile dome 162 aiding in the distribution of the force (F) to first support 144. Where the force (F) is applied to base portion 146 via second support 158, base portion 146 may deflect or deform. More specifically, the segment (e.g., center) of base portion 146 positioned in alignment with second support 158 may substantially deflect or deform as a result of: the force (F) being applied through button 108 and second support 158, the thickness of base portion 146 and/or the distance from sidewalls 112 of housing 102.

As shown in FIG. 6C, the deflection or deformation of base portion 146 may cause a change in the thickness ($\Delta T$) of base portion 146 of housing 102. That is, the thickness (T) of base portion 146 may no longer be uniform (e.g., FIGS. 6A and 6B) because of the force applied by second support 108, and may ultimately cause a change in the thickness ($\Delta T$) of the segment of base portion 146 positioned above sensing component 164. In deforming base portion 146 when button 108 is in an actuated state, piezoelectric sensor 166 (e.g., sensing component 164) may also be deformed. That is, as a result of base portion 146 deforming from the force (F) being applied during an actuated state of button 108, piezoelectric sensor 166 (e.g., sensing component 164) may deformed by base portion 146, and may send an electrical signal to a distinct component of electronic device 10 via wires 168. As showing in FIG. 6C, the deformation of base portion 146 may cause a similar deformation in piezoelectric sensor 166.

Additionally, as shown in FIG. 6C, when button 108 is in an actuated state, top surface 114 may be positioned substantially below top surface 106 of housing 102. That is, in an actuated state, top surface 114 of button 108 may be temporarily out of planar alignment with top surface 106 of housing 102. Furthermore, where button 108 is in an actuated state and displaced within opening 104 of housing 102, engagement components 130, and specifically clips 132, of button 108 may be displaced even further when compared to button 108 in a partially actuated state. That is, as shown in FIG. 8, clips 132 may no longer contact underside surface 142 of apertures 110, and may be positioned even further from underside surface 142 when compared to button 108 in a partially actuated state, as shown in FIG. 6B.

Once the force (F) is no longer being applied to button 108, waterproof button assembly 100 may return to an unactuated state (e.g., FIG. 6A). More specifically, after the force (F) is removed from top surface 114 of button 108, base portion 146, tactile dome 162 and/or piezoelectric sensor 166 may return to their original configuration (e.g., no deformation, deflection or displacement), and may aid in displacing button 108 back to its original position. For example, substantially flat tactile dome 162 in the unactuated state may return to its original configuration (e.g., dome) when the force (F) is removed. In returning to its original configuration, tactile dome 162 may push button 108 toward top surface 106 of housing 102 until clips 132 (e.g., engagement components 130) contact underside surface 142 of opening 104. Once clips 132 contact underside surface 142 again, button 108 may be held in opening 102 via clips 132 positioned within opening 102 and top surface 114 of button 108 may be in planar alignment with top surface 106 of housing 102.

Figure 7:
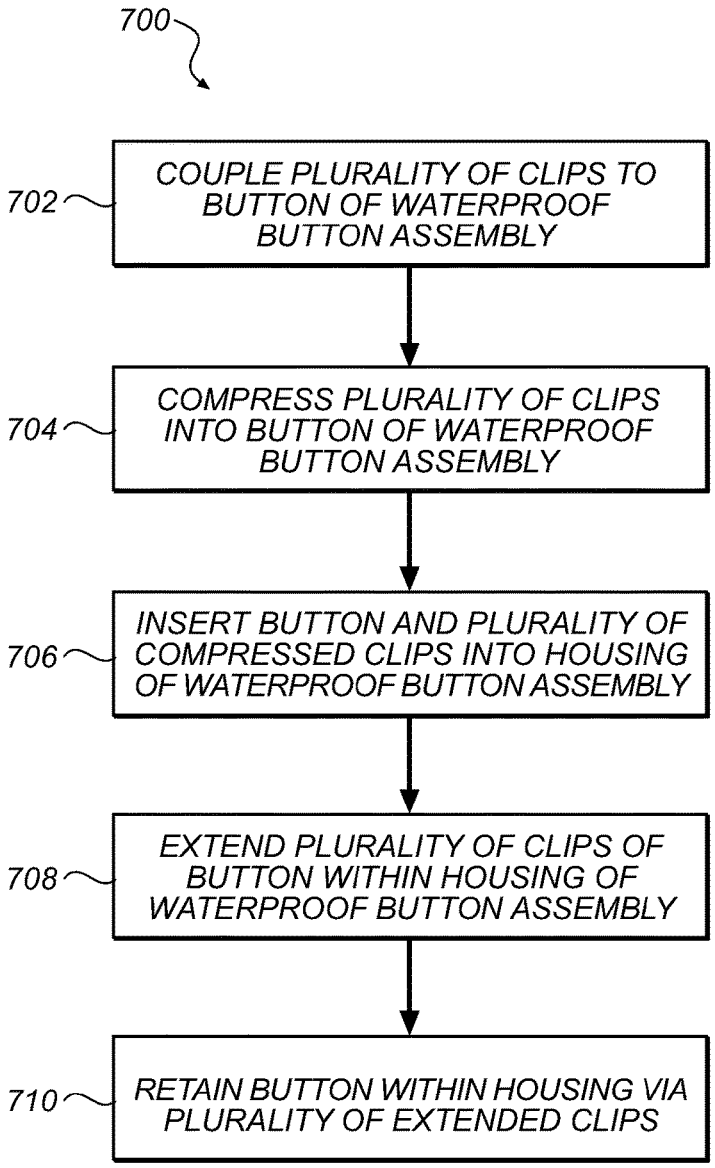
FIG. 7 is a flow chart illustrating a method for assembling a waterproof button assembly. This method may be performed by the waterproof button assembly as shown in FIGS. 2-4.
Figure 8A:
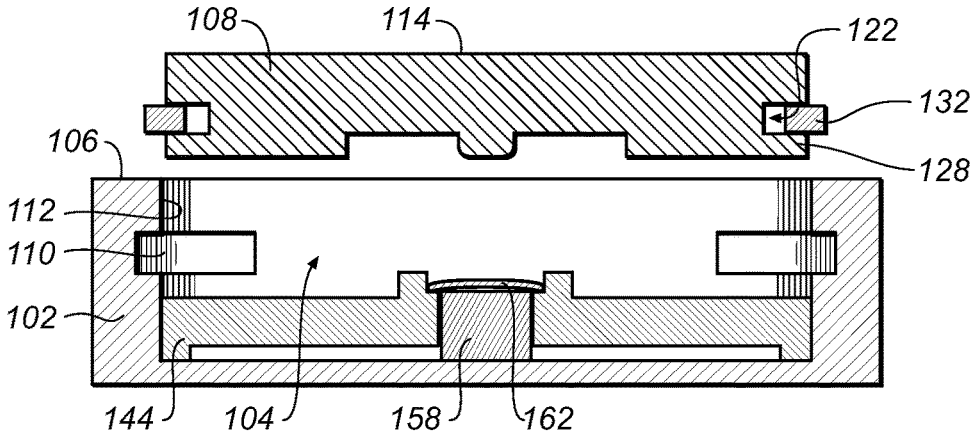
FIGS. 8A-8D show an illustrative front cross-sectional view of a waterproof button assembly undergoing processes of assembling as depicted in FIG. 7, according to embodiments.
Figure 8B:
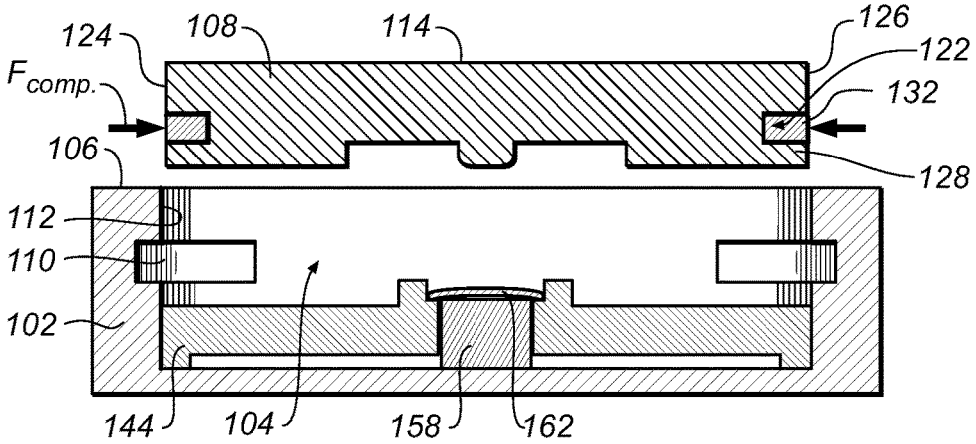
Figure 8C:
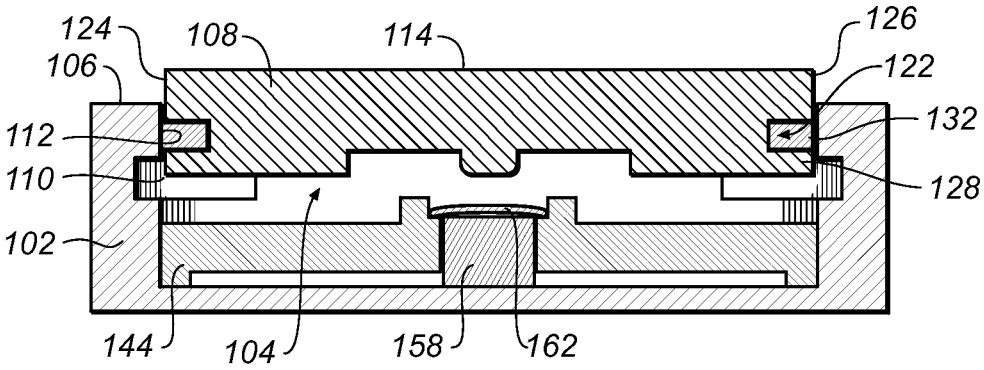
Figure 8D:
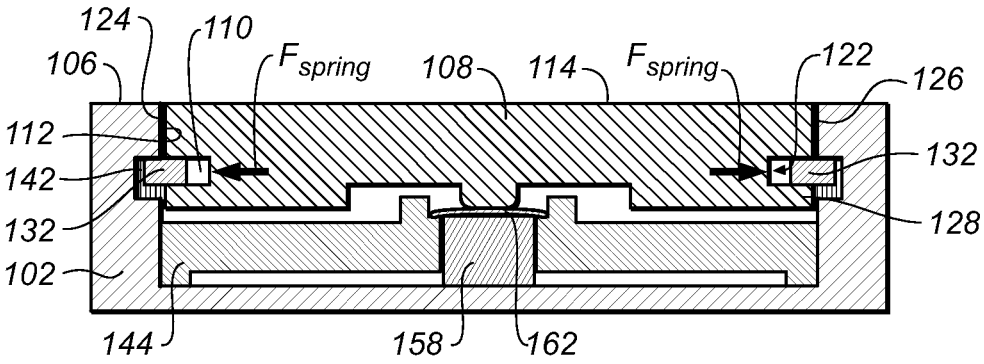

Turning to FIGS. 7-8D, a method for assembling waterproof button assembly 100 may now be discussed. Specifically, FIG. 7 is a flowchart depicting one sample method 900 for assembling waterproof button assembly 100. FIGS. 8A-8D may depict a side cross-sectional view of waterproof button assembly 100 undergoing method 700, as depicted in FIG. 7. It is understood that similarly numbered components may function in a substantially similar fashion. Redundant explanation of these components has been omitted for clarity.

In operation 702, the plurality of clips 132 (e.g., engagement components 130) may be coupled to distal ends 124, 126 of button 108. As shown in FIG. 8A, and discussed above, each of the plurality of clips 132 may be slidingly engaged to one of the plurality of grooves 122 of button 108 and may be substantially free to move distally while slidingly engaged to button 108. In operation 702, as shown in FIG. 8A, clips 132 may extend distally beyond distal ends 124, 126 of button 108 during the coupling process. Also discussed above, clips 132 may rest upon contact surface 140 of shelf portion 128 to substantially prevent clips 132 from rotating within grooves 122 of button 108.

In operation 704, the plurality of clips 132 may be compressed into button 108. As shown in FIG. 8B, a compression force ($F_{comp}$) may be applied to each clip 132 to move clips 132 toward center portion 136 of button 108. As discussed herein, as clips 132 move toward center portion 136, ends 138 of clips 132 may contact angled surface 134 of center portion 136 and may temporarily increase the width of clips 132. In compressing clips 132 into button 108, clips 132 may no longer extend beyond distal ends 124, 126. That is, the clips 132 may be compressed to be in substantial alignment with distal ends 124, 126 of button 108. As such, when clips 132 are in a compressed state, clips 132 may not extend the width of button 108 beyond the width of opening 104 of housing 102. The compressing of the plurality of clips 132 in operation 704 may further including temporarily maintaining clips 132 in a compressed position. That is, after clips 132 are compressed into button 108, clips 132 may be held in the compressed state until further processes of assembling waterproof button assembly 100 are completed, as discussed herein.

In operation 706, button 108 and the plurality of compressed clips 132 may be inserted into housing 102. As shown in FIG. 8C, button 108, including compressed clips 132 may be inserted into housing 102 while clips 132 remain compressed. That is, button 108 and clips 132 may be inserted through opening 104 formed through top surface 106 of housing 102. Lower portion 120 may be inserted into opening 104 first, such that clips 132 may be temporarily positioned within opening 104 of housing 102 and top surface 114 of button 108 may be temporarily positioned substantially above top surface 106 of housing 102. As shown in FIG. 8C, during the insertion process, clips 132 may slightly extend distally from button 108 to contact sidewalls 112 of opening 104 of housing 102. Although, clips 132 may contact sidewalls 112 of opening 104 during the insertion process, clips 132 and/or sidewalls 112 of opening 104 may not substantially prevent button 108 from being completely inserted into opening 10. That is, clips 132 may contact sidewalls 112 during the insertion of button 108 and clips 132 into housing 102, and clips 132 may slidingly move along sidewalls 112 of opening 104 as button 108 is inserted into housing 102.

In operation 708, the plurality of clips 132 of button 108 may be extended within housing 102. As shown in FIG. 8D, each of the plurality of clips 132 may extend distally from lower portion 120 of button 108, and may extend beyond distal ends 124, 126 of button 208. As discussed herein, when clips 132 of button 108 extends within housing 102, each of the plurality of clips 132 may extend distally from button 108 into apertures 110 formed in sidewalls 112 of housing 102. The extending of the plurality of clips 132 may further include applying a spring force (Fspring) to each of the plurality of clips 132 to displace the plurality of clips 132 distally from button 108. That is, and as discussed herein with respect to FIG. 3B, the plurality of clips 132 may extend within housing 102 as a result of the spring force applied to clips 132 via angled surface 134 of center portion 136. More specifically, as a result of the compressing of the clips 132 in operation 904, a spring force may be applied to each of the plurality of clips 132 as ends 138 of clips 132 move along angled surface 134 toward the center of button 108. As button 108 is inserted into housing 102, sidewalls 112 may retain clips 132 in a compressed state and overcome the spring force placed on the clips. However, as clips 132 of button 108 become aligned with apertures 110 of housing 102, the spring force placed on clips 132 from angled surface 134 of center portion 136 may extend or displace the clips 132 distally, such that clips 132 extend distally beyond distal ends 124, 126 of button 108 and extend into aperture 110.

In operation 710, button 108 may be retained within housing 102 via the plurality of extended clips 132. As shown in FIG. 8D, the retaining of button 108 within housing 102 may include positioning at least a portion of each of the plurality of clips 132 of button 108 within one of the plurality of apertures 110 within housing 102. More specifically, and as discussed herein with respect to FIG. 4, button 108 may be retained within housing 102 by positioning clips 132 within apertures 110 of housing 102, where clips 132 may contact underside surface 142 of aperture 110. By extending clips 132 into aperture 110 to contact underside surface 142, button 108 may be retained in opening 104 of housing 102 and/or may be substantially prevented from being removed from housing 102 via opening 104.

Figure 9A:
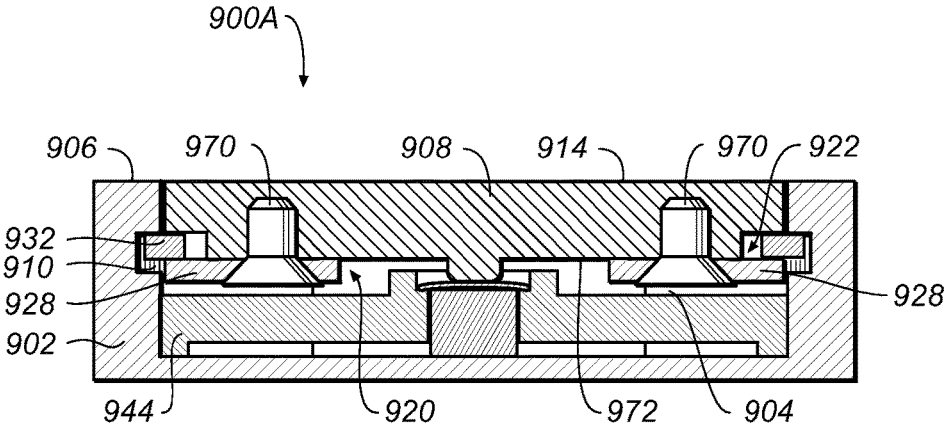
FIGS. 9A-14 show an illustrative front cross-sectional view of a plurality of waterproof button assembly, according to alternative embodiments.

FIGS. 9A-14 illustrate side-cross sectional views of additional embodiments of waterproof button assembly. In one additional embodiment, as shown in FIG. 9A, waterproof button assembly 900A may include substantially similar components (e.g., housing 902, button 908, first support 944, etc.) as waterproof button assembly 100 as shown in FIGS. 2-4. As such, redundant explanation of the similar components is excluded for clarity. As shown in FIG. 9A, button 908 of waterproof button assembly 900A may include a distinct shelf portion 928 of lower portion 920. That is, lower portion 920 of button 908 may include distinct shelf portion 928 that may be coupled to the plurality of grooves 922 and/or upper portion 916 of button 908. Distinct shelf portion 928 may be releasably coupled to button 908 of waterproof button assembly 900A. In an example embodiment, as shown in FIG. 9A, shelf portion 928 may be releasably coupled to button 908 via a plurality of mechanical fasteners 970. Mechanical fasteners 970 may be positioned through bottom surface 972 of button 908 adjacent first support 944. Mechanical fastener 970 may also extend partially through button 908 toward top surface 914 to couple shelf portion 928 to button 908. Mechanical fasteners 970 used to releasably couple distinct shelf portion 928 to button 908 may include any conventional fastener including, but not limited to: screws, bolts, snap-fits, rivets, etc.

Figure 9B:
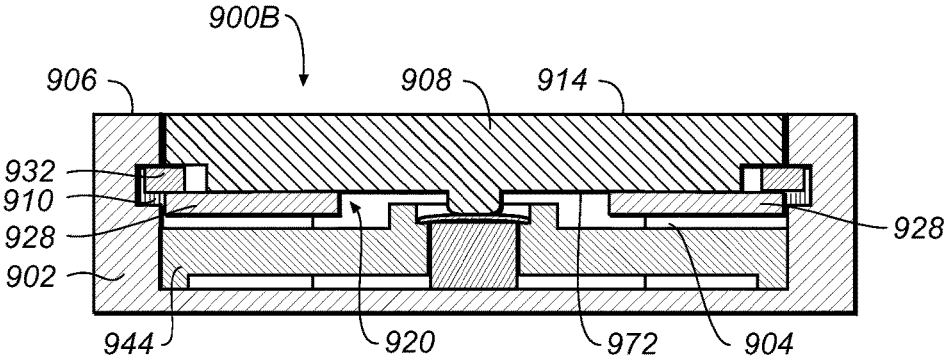

In another example embodiment where waterproof button assembly 900B includes distinct shelf portion 928, distinct shelf portion 928 may be mechanically fixed to button 908. More specifically, as shown in FIG. 9B, distinct shelf portion 928 may be fixed to bottom surface 972 of button 908, adjacent first support 944. Distinct shelf portion 928 may be mechanically fixed to button 908 using any conventional mechanical fixing technique including, but not limited to: welding, brazing, soldering, adhering, etc.

Figure 10:
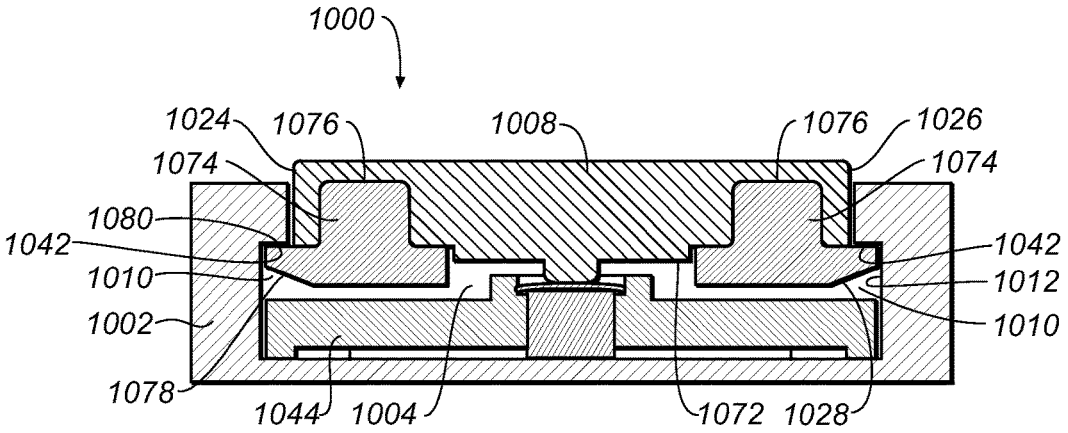

In an additional example embodiment, as shown in FIG. 10, engagement component 1030 of waterproof button assembly 1000 may include a press-fit protrusion 1074. More specifically, engagement component 1030 may include a plurality of press-fit protrusions 1074 extending distally from each distal end 124, 126 of button 1008. Press-fit protrusions 1074 may be a distinct component, and may be coupled to button 1008. That is, each press-fit protrusions 1074 may be inserted and coupled to an opening 1076 formed in button 1008. Press-fit protrusions 1074 of waterproof button assembly 1000 may include chamfered surface 1078 positioned on each distal end 1024, 1026 of button 108. More specifically, as shown in FIG. 10, press-fit protrusions 1074 may include chamfered surface 1078 extending from each distal end 1024, 1026 of button 1008. When inserting button 1008 into housing 1002 to form waterproof button assembly 1000, chamfered surface 1078 of press-fit protrusion 1074 may aid in positioning button 1008 within opening 1404. That is, when inserting button 1008 into opening 1004 of housing 1002, chamfered surface 1078 of press-fit protrusion 1074, which includes a width greater than the width of opening 1004 positioned adjacent top surface 1006, may include an angle to button 1008 to be pressed or snapped into opening 1004.

As shown in FIG. 10, press-fit protrusion 1074 may include a contact edge 1080 positioned adjacent chamfered surface 1078. Contact edge 1080 may be configured to contact underside surface 1042 of aperture 1010 of housing 1002. That is, and similarly discussed with respect to clips 132 in FIG. 4, at least a portion of each of the plurality of press-fit protrusions 1074 (e.g., contact edge 1080) may be positioned within one of the plurality of apertures 1010 in sidewall 1012 of housing 1002 for retaining button 1008 in housing 1002. Contact edge 1080 may contact underside surface 1042 of opening 1010 to retain button 1008 within housing 1002. In comparison to FIG. 4, apertures 1010 formed in sidewalls 1012 of housing 1002 may be formed in the majority of housing 1002. That is, the plurality of apertures 1010 may be formed in the majority of sidewalls 1012 of opening 1004, such that a portion of press-fit protrusions 1074 (e.g., chamfered surface 1078, contact edge 1080) and first support 1044 may be positioned within apertures 1010 of housing 1002.

In other example embodiments, as shown in FIGS. 16*a* and 16*b*, waterproof button assembly 1600 may include housing 1602 having a removable base plate 1682 forming base portion 1646. More specifically, housing 1602 may include a distinct, removable base plate 1682 which may be coupled to sidewalls 1612 to form base portion 1646 of housing 1602. Removable base plate 1682 may be releasably coupled or mechanically fixed to sidewalls 1612 using any conventional fastener or coupling technique, discussed herein. Where housing 1602 includes removable base plate 1682, opening 1604 may extend completely through housing 1602. Including removable base plate 1682 may aid in the inserting of button 1608*a*, 1608*b* into opening 1602. More specifically, button 1608*a*, 1608*b* may be inserted into opening 1604 of housing 1602 via opening covered by removable base plate 1682, prior to coupling removable base plate 1682 to sidewalls 1612 to form housing 1602. As a result of removable base plate 1682, button 1608*a*, 1608*b* may not need to be inserted through opening 1604 adjacent top surface 1606 of housing 1602, and ultimately may or may not require engagement components 1630 (e.g., clips, snap-fit protrusions 1074) that must fit through opening 1604 via top surface 1606.

Figure 11A:
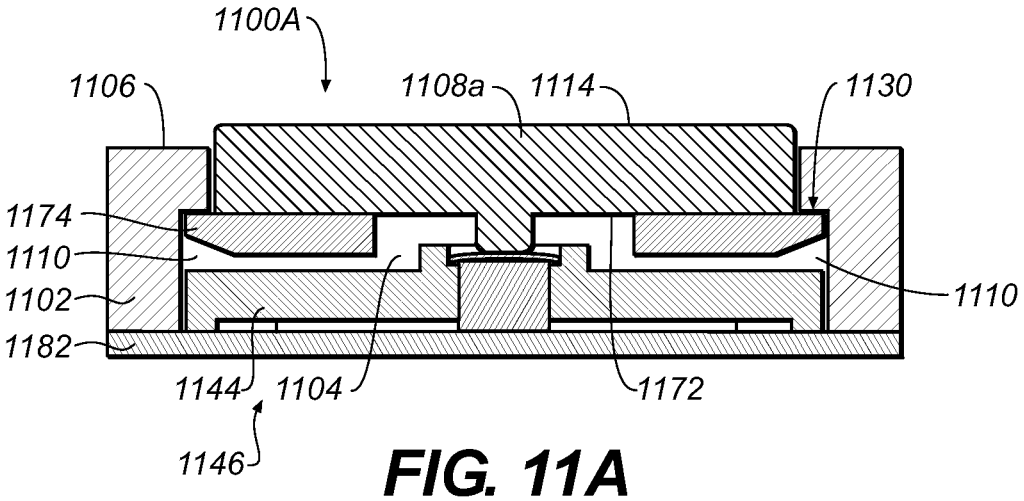
Figure 11B:
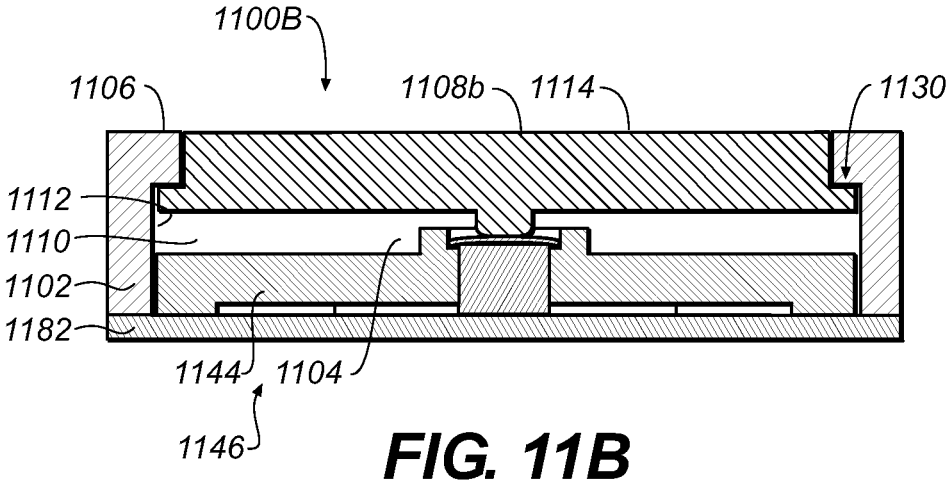

For example, as shown in FIG. 11A, button 1108A may include a plurality of distinct press-fit protrusions 1174 that may be mechanically fastened or releasably coupled to button 1108*a*. Button 108*a* of FIG. 11A may be inserted into opening 1104 of housing 1102 adjacent top surface 1106 or inserted into opening 1104 opposite top surface 1106, that may be subsequently covered by removable base plate 1182. Conversely, in FIG. 11B, button 1108B may be a single component. More specifically, button 1108B and the plurality of engagement components 1130 may be a single, integral component. Button 1108B may include substantially rigid, polygonal engagement components 1130 that are integral with button 1108B, and may include a width wider than a portion of opening 1104 positioned adjacent top surface 1106 of housing 1102. As a result of the configuration of button 1108B and engagement components 1130 being a single, integral piece, button 1108*b* of FIG. 11B may be inserted through opening 1104 opposite top surface 1106, and may be positioned within housing 1102 adjacent top surface 1106. Once button 1108*b* may be positioned within housing 1102 via opening 1104, removable base plate 1182 may be coupled or fixed to housing 1102.

Figure 12:
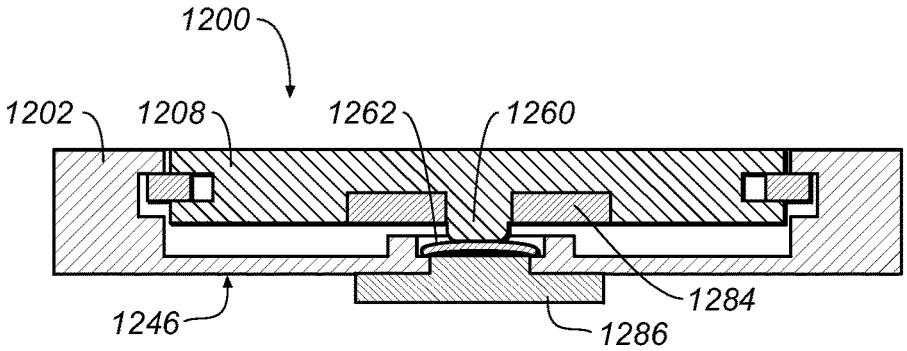
Figure 13:
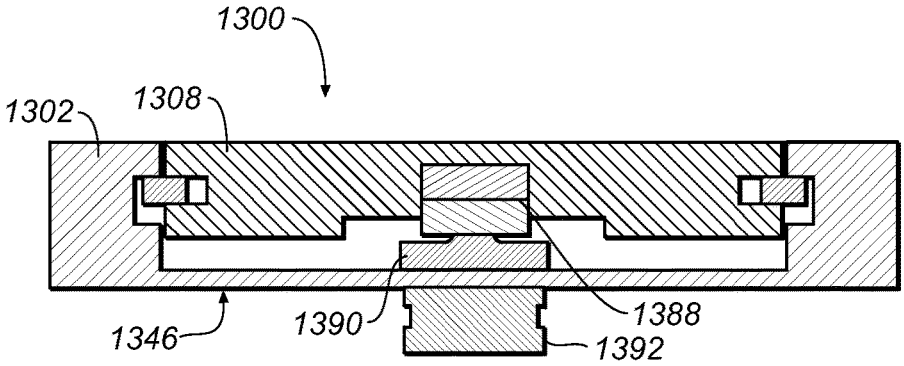
Figure 14:
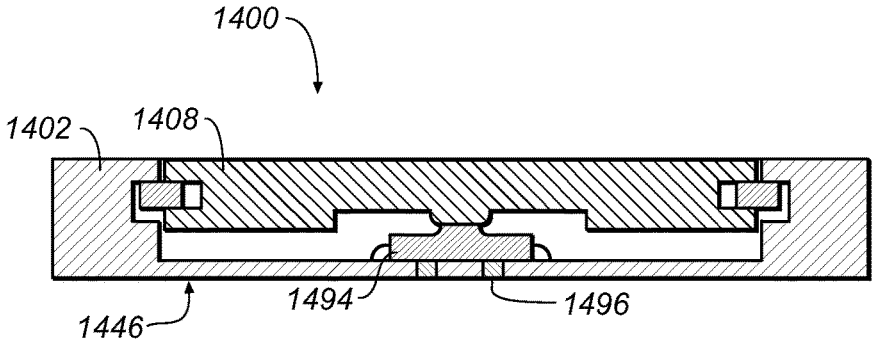

In additional embodiments, as shown in FIGS. 12-14, sensing component 164 may be configured as a variety of distinct, conventional sensing components. A brief explanation of each of the variety of distinct, conventional sensing components may be provided for clarity. For example, in an embodiment of FIG. 12, sensing component 1264 may include a conventional optical sensor. Optical sensor (e.g., sensing component 1264) may include a laser or light emitter component 1284 positioned within button 1208 of waterproof button assembly 1200. Laser or light emitter component 1284 may be configured to provide a light source that may substantially light opening 1204 of waterproof button assembly 1200. Optical sensor, as shown in FIG. 12, may also include a photodiode component 1286 positioned below housing 1202. More specifically, optical sensor forming sensing component 1264 may include photodiode component 1286 positioned below base portion 1246, and outside of housing 1204. In an unactuated state, the light emitted by light emitter component 1284 may substantially light opening 1204 and may also shine through tactile dome 1262 to photodiode component 1286. The light of light emitter component 1284 may shine through glass or another clear material (not shown) positioned within base portion 1246 between button 1208 and photodiode component 1286, forming a hermetic seal between opening 1204 and photodiode component 1286. Conversely, during actuation of button 1208, the light emitted by light emitter component 1284 may be substantially blocked from photodiode component 1286. As a result of not being exposed to the light produced by light emitter component 1284, photodiode component 1286 may recognize actuation of button 208 and may subsequently send an electrical signal to a component of electronic device 10 (FIG. 1) via electrical wires (not shown).

In another example embodiment, as shown in FIG. 13, sensing component 1364 may include a conventional magnetic sensor. As shown in FIG. 13, sensing component 1364 of waterproof button assembly 1300 may include a magnet 1388 position within button 1308, and a tactile (TAC) switch 1390 positioned adjacent magnet 1388. Both magnet 1388 and TAC switch 1390 may be positioned within opening 1304 of waterproof button assembly 1300. Magnetic sensor (e.g., sensing component 1364) may also include a reed switch 1392 positioned adjacent TAC switch 1390. More specifically, as shown in FIG. 13, reed switch 1392 may be positioned adjacent TAC switch 1390, outside of housing 1302. In an unactuated state, reed switch 1392 may not complete a circuit with wires (e.g., not shown) electrically coupled to a component of electronic device 10 (FIG. 1). However, in an actuated state of button 1308, magnet 1388 may move toward TAC switch 1390 and reed switch 1392, respectively, such that the magnet field adjacent reed switch 1392 may be increased. Where the magnetic field increases in the actuated state, reed switch 1392 may complete the electrical circuit for the wires (not shown) of sensing component 1364, and may ultimately send an electrical signal to a component of electronic device 10 (FIG. 1).

In a further embodiment, as shown in FIG. 14, sensing component 1464 may include a conventional TAC switch. As shown in FIG. 14, TAC switch may include a connector component 1494 positioned within housing 1402 and a plurality of electrical contacts 1496 positioned adjacent connector component 1494. Electrical contacts 1496 may be formed within and/or through base portion 1446 of housing 1002 and may be electrically coupled to various components of the electronic device 10 (FIG. 1) via wires (not shown). As shown in FIG. 14, electrical contacts 1496 may fit within, and be positioned through base portion 1446, to form a hermetic seal within housing 1402 of waterproof button assembly 1400. In an unactuated state, connector component 1494 may not contact electrical contacts 1496, which may place the electrical contacts 1496 in an open position. When in an open position, no electrical current may flow between electrical contacts 1496, which ultimately may result in no electrical current flowing to the component of electronic device 10 electrically coupled to electrical contacts 1496 of TAC switch of waterproof button assembly 1400. Conversely, when button 1408 is actuated, connector component 1494 may contact both electrical contacts 1496, placing the electrical contacts 1496 in a closed position. In a closed position, connector component 1494 may complete the electrical connection between the electrical contacts 1496, such that an electrical current may flow between the electrical contacts 1496, via the connector component 1494, and ultimately to the component of the electronic device 10 (FIG. 1). In a closed position, the component of the electronic device 10 electrically coupled to TAC switch may then be engaged or interacted with.

By utilizing the waterproof button assembly with an electronic device, as discussed herein with respect to FIGS. 1-14, the risk of exposure to harmful elements may be substantially eliminated. More specifically, by utilizing the waterproof button assembly discussed herein, the negative effects caused by water exposure to the electronic device may be substantially minimized or eliminated. By including an integral, single component housing and/or by placing at least a portion of the electrical components of a sensing component outside of the housing of the waterproof button assembly, water and other harmful elements may not come in contact with electrically sensitive portions (e.g., wires) of the sensing component. By providing that barrier and/or preventative configuration, only the mechanical portions (e.g., button, tactile dome, etc.) of the waterproof button assembly may be exposed to water and other harmful elements. As discussed herein, and as appreciated by one skilled in the art, because of the mechanical components configuration and/or material composition, the exposure to these elements may not negatively affect the operation or function of these components. As a result, the waterproof button assembly, as discussed herein, may provide continuous operation and function within an electronic device while also maintaining protection against the electronic device's exposure to harmful elements.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A waterproof button assembly comprising:

a housing forming exterior and interior surfaces of an electronic device and defining an opening and a base portion at a bottom of the opening;

a button positioned at least partially within the opening;

a tactile dome positioned between the button and the base portion;

a set of engagement components positioned around a periphery of the button, each component of the set of engagement components engaging apertures positioned on a sidewall of the opening within the housing thereby retaining the button within the housing; and a sensing component positioned on the housing at the interior surface opposite the button and configured to detect a deformation of the base portion due to an actuation of the button along a direction substantially perpendicular to the exterior surface.

2. The waterproof button assembly of claim 1, wherein the button includes a pattern of grooves positioned on the distal ends of the button.

3. The waterproof button assembly of claim 2, wherein the set of engagement components includes a group of clips, each clip of the group of clips slideably engaging with one of the pattern of grooves of the button.

4. The waterproof button assembly of claim 3, wherein at least a portion of each of the group of clips is positioned within one of the apertures in the sidewall of the housing for retaining the button within the housing.

5. The waterproof button assembly of claim 1, wherein the set of engagement components includes a set of press-fit protrusions extending distally from the button.

6. The waterproof button assembly of claim 5, wherein at least a portion of each of the set of press-fit protrusions is positioned within one of the apertures in the sidewall of the housing for retaining the button within the housing.

7. The waterproof button assembly of claim 1, wherein:

the waterproof button assembly further comprises:

a first support positioned within the housing adjacent the button; and a second support positioned within the housing adjacent the button, the second support substantially surrounded by the first support; and the tactile dome is positioned between the second support and the button, the tactile dome contacting the button.

8. The waterproof button assembly of claim 1, wherein the sensing component is selected from a group consisting of: a piezoelectric sensor, an optical sensor, a magnetic sensor and a TAC switch.

9. The waterproof button assembly of claim 1, wherein the housing includes a removable backplate.

10. The waterproof button assembly of claim 1, wherein the button and the set of engagement components are a single, integral component.

11. An electronic device comprising:

a waterproof button assembly comprising:

a housing coupled with a casing and defining an opening and a base portion forming a portion of the opening;

a button positioned at least partially within the housing at the opening;

a tactile feedback structure coupled to the button;

a set of engagement components positioned around the button for retaining the button within the housing, each component of the set of engagement components engaging apertures positioned on a sidewall of the opening within the housing; and a sensing component positioned within an interior volume defined by the casing and the housing, wherein:

the sensing component is configured to identify a localized deflection of the base portion due to an actuation of the button along an axial direction extending through the opening and the base portion; and the base portion of the housing separates the button from the interior volume.

12. The electronic device of claim 11, wherein the sensing component of the waterproof button assembly is positioned adjacent to a base portion of the housing, and at least a portion of the sensing component is separated from the opening formed partially through the housing by the base portion.

13. The electronic device of claim 11, wherein the set of engagement components are compressible.

14. The electronic device of claim 11, wherein each component of the set of engagement components comprises a moveable clip.

15. The electronic device of claim 14, wherein the moveable clip is spring loaded.

16. A method for assembling a waterproof button, the method comprising:

coupling a set of clips to distal ends of a button, the button having first and second portions;

compressing the set of clips into the button;

inserting the first portion of the button and the set of compressed clips into an opening of a housing such that the second portion of the button extends above the housing, the opening defined along an exterior surface of the housing;

extending the set of clips of the button into apertures positioned on one or more sidewalls of the opening within the housing; and retaining the button within the housing via the set of extended clips; and disposing a sensing component adjacent an interior surface of the housing, the sensing component configured to produce an electrical response in response to a deformation of the interior surface of the housing caused by the second portion of the button moving into the opening.

17. The method of claim 16, wherein the extending of the set of clips includes applying a spring force to each of the set of clips to displace the set of clips distally from the button.

18. The method of claim 16, wherein the coupling of the set of the clips includes slideably engaging each clip of the set of clips to one of a group of grooves positioned on the distal ends of the button.

* * * * *